US005281233A

United States Patent [19]

Dolev

[11] Patent Number: 5,281,233

[45] Date of Patent: Jan. 25, 1994

[54] DISC ASSEMBLY HAIR REMOVER

[76] Inventor: Moshe Dolev, 22 Yechiam, Ramat Hasharon, Israel

[21] Appl. No.: 16,895

[22] Filed: Feb. 12, 1993

[51] Int. Cl.[5] ..... A45D 26/00

[52] U.S. Cl. ..... 606/133; 606/131

[58] Field of Search ..... 452/71, 82, 83, 84, 452/86, 88, 99, 101, 102; 606/131, 133

[56] References Cited

U.S. PATENT DOCUMENTS

| | | | |
|---|---|---|---|
| 4,935,024 | 6/1990 | Dolev | 606/133 |
| 5,057,115 | 10/1991 | Dolev | 606/133 |
| 5,084,055 | 1/1992 | Demeester | 606/133 |
| 5,100,413 | 3/1992 | Dolev | 606/133 |
| 5,108,410 | 4/1992 | Iwasaki et al. | 606/133 |
| 5,112,341 | 5/1992 | Dolev | 606/133 |
| 5,190,559 | 3/1993 | Gabion et al. | 606/133 |
| 5,196,021 | 3/1993 | Kabla | 606/133 |
| 5,197,969 | 3/1993 | Visscher et al. | 606/133 |

*Primary Examiner*—Stephen C. Pellegrino
*Assistant Examiner*—Glenn K. Dawson
*Attorney, Agent, or Firm*—Mark M. Friedman

[57] ABSTRACT

A device for removing body hair, which includes a housing a hair-plucking portion which is rotatably mounted to the housing. The hair-plucking portion includes one or more disc assemblies, each of which includes a pair of complementary discs, each of which has one or more radially extending arms which terminate in a flattened peripheral portion. When the corresponding portions of the two discs are pressed together, they form a trap for the hair. The disc assemblies also include a hub which accommodates a pair of discs, one on each of its axial faces. The hub has shoulders for engaging the arms of each of the discs so as to impart rotational motion to the discs upon the rotation of the hub. The hub also has at pairs of protrusions which extend axially beyond the plane of arms of each disc. The hub further has an edge which is perpendicular to its axis such that each pair of arms of the pair of discs is pivotable about the edge so as to alternately bring the corresponding flattened peripheral portions of the discs together to form a trap and apart to eject the removed hair. The hubs may be mounted on a fixed curved shaft and may be connected so that each hub transfers the rotational motion to the adjoining hub. Alternatively, the hubs may be mounted on a rotatable straight shaft which imparts rotational motion to each hub.

20 Claims, 2 Drawing Sheets

DISC ASSEMBLY HAIR REMOVER

FIELD AND BACKGROUND OF THE INVENTION

The present invention relates to depilatory devices for removing body hair and, more particularly, to devices for removing unwanted body hair by uprooting the hair.

A large number of depilatory devices have been proposed through the years. Depilation can be effected in one of two basic processes. In one process, implemented by shavers of various types, strands of hair are cut, typically in the vicinity of the skin, leaving the roots intact and in place beneath the skin surface. In the other basic process, which will henceforth be referred to as 'hair removal', hair is removed without cutting the strands, typically by vigorously pulling the hair strands so as to uproot the hair and remove the entire hair, including the roots.

In a number of applications, such as in the depilation of women's legs, it is considered preferable to uproot hair rather than to cut it since the removal of the roots considerably slows, and to some extent permanently thwarts, the growth of replacement hair, and leaves the skin relatively smooth and virtually free of hair for relatively long periods of time. By contrast, cutting the hair, as by shaving, does nothing to interrupt or disrupt the hair growth and often leads to the early appearance of unsightly stubble as the cut hairs continue to grow.

Processes for the mechanical uprooting of hair generally involve grasping one or more strands of hair and vigorously pulling on the hair so as to remove the entire hair, including its roots. Care must be taken that the hair thus grasped and pulled is not inadvertently cut in the process. Care must also be taken to ensure that the pulling of hair occurs sufficiently quickly that the user does not sense an unacceptable amount of pain or discomfort. As may well be appreciated, everything else being equal, the quicker the pulling action, the less painful is the uprooting.

Various devices for accomplishing hair removal have been described and reviewed in my earlier U.S. Pat. Nos. 4,935,024 and 5,057,115 which are incorporated herein by reference for all purposes as if fully set forth herein.

Several of the proposed hair removal systems involve the use of tilted discs which come together at a point to grasp one or more strands of hair. In such systems, strands of hair are grasped at the point where the two discs momentarily come together and are pulled as the discs continue to rotate. Further rotation of the discs causes the distance between the discs to increase, allowing the uprooted hair to drop from the device.

Such systems generally suffer from at least two disadvantages. First, the pinching of a strand of hair at the point of contact between the two discs often results in the undesired cutting of the hair, rather than in its desired uprooting. Second, since the discs are only in contact momentarily and at a single point, a hair which is grasped at the point of contact will be released soon thereafter as the discs continue to rotate. Often, such release will occur before the hair has been displaced sufficiently to be uprooted. The result is that the hair will remain in place, firmly attached to the skin by its root. Such a phenomenon is unfortunate since, not only does the hair remain in place unremoved but the user has also had to suffer needless discomfort or even pain as the hair was pulled partially prior to being released.

Other of the proposed hair removal systems involve the use of cams to alternately bring discs, or similar members, together and apart periodically to effect the grasping and releasing of strands of hair. In some cases, the discs or other members are flattened at their outer periphery so as to provide a region where hairs can be grasped which is larger than the single point afforded by a pair of ordinary discs. All such cam-based systems suffer from the disadvantage that the use of cams induces an undesirable vibration in the device, which is transmitted to the user and reduces his or her level of comfort.

In addition, some cammed systems involve the slight displacement of the traps from their undisplaced position, such the trap is effected in a location which is slightly displaced from where the trap elements were prior to the formation of the plate. A difficulty with this arrangement is that shorter hairs which are initially introduced into the trap area may escape the trap before the trap is closed because of the slight displacement of the trap elements.

Efforts have been made to increase the size of the regions over which hair can be grasped by using discs or similar elements which are in some sense resilient. One such system is disclosed, for example, in U.S. Pat. No. 4,807,624. However, such systems are also not free from difficulties. Specifically, since such a system has a certain amount of resiliency, or 'give', once hair has been grasped, the grasping member has a tendency to be pulled by the hair toward the skin. This prolongs the act of uprooting the hair and accordingly increases the amount of discomfort or pain experienced by the user.

Recently, Philips N.V. has been marketing a hair remover under the name of New Satinelle which attempts to overcome many of the above-described limitations. The Philips device features a number of discs which are stacked on a rotatable assembly made up of three straight parallel shafts. The two end walls which touch the outer discs, which are different in construction from the intermediate discs, are angled so as to tilt one portion of each of the outer discs approximately perpendicular to the shafts. Each of the discs of the Philips device is made up of a metal portion and a complex integral plastic portion which includes a number of complicated protrusions and recessions designed to transfer the tilt of the outer discs to the intermediate discs. The tilt produces regions where adjoining discs alternately come together to form a temporary trap for the hair and move apart to release the uprooted hair.

While the Philips device appears to overcome several of the disadvantages of the previously known systems, the device displays at least three difficulties. First, the Philips design calls for the use of two different disc assemblies, which unnecessarily complicates the assembly and maintenance of the unit. Second, close inspection of the Philips disc assembly reveals that the assembly provides only one hair trap per rotation of each disc, which makes it necessary to use a relatively large number of rather closely-spaced discs. Finally, it is to be noted that the Philips device is asymmetrical and operates properly only when the discs are rotated in one sense and not the other.

There is thus a widely recognized need for, and it would be highly advantageous to have, an inexpensive and rugged hair removal device which is capable of efficiently grasping hair over a large trap area, without undesired displacement, and which can then hold the trapped hair long enough to quickly, and relatively painlessly, uproot the hair, which device will provide a relatively large number of traps per rotation of each disc, will be symmetrical and therefore function equally well in either rotational sense, and will make use a plurality of disc assemblies which are all identical, for easy assembly and maintenance.

SUMMARY OF THE INVENTION

According to the present invention there is provided a device for removing body hair, comprising: (a) a manually grippable housing; and (b) a hair-plucking assembly rotatably mounted to the housing, the hair-plucking assembly including at least one disc assembly, the disc assembly including: (i) a pair of complementary discs, each of the discs having at least one radially extending arm, the arm terminating in a flattened peripheral portion which, when pressed against the corresponding portion of the other disc forms a trap for the hair; and (ii) a hub for accommodating one of the pair of discs on each of its axial faces, the hub having at least one shoulder for engaging the at least one arm of each of the pair of discs so as to impart rotational motion to the pair of discs upon rotation of the hub, the hub having at least a pair of protrusions which extend axially beyond the plane of the arm of each of the pair of discs, the hub further having an edge substantially perpendicular to the axis of the hub such that the at least one pair of arms of the discs is pivotable about the edge so as to alternately bring the corresponding flattened peripheral portions of the discs together to form a trap and apart to eject the removed hair.

According to further features in preferred embodiments of the invention described below, the discs are made of a rigid material, such as metal, and the disc assemblies are all identical.

According to still further features in the described preferred embodiments, the disc assemblies are symmetrical with respect to clockwise or counterclockwise rotation.

According to one embodiment according to the present invention the hubs are rotatably mounted on a fixed arcuate shaft and each hub includes engagement means for engaging at least one adjoining hub so that rotational motion of one hub imparts rotational motion to an adjoining hub.

According to another embodiment according to the present invention hubs are mounted on a rotatable substantially straight shaft and each hub includes engagement means for engaging the rotatable shaft so that rotational motion of the shaft imparts rotational motion to the hub.

The present invention successfully addresses the shortcomings of the presently known configurations by providing a hair remover which overcomes the various disadvantages of presently known devices.

The present invention discloses a novel hair removal device which includes disc assemblies which are designed to alternately form and undo a large number of relatively large hair traps for the efficient and relatively painless removal of body hair.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a hair removal device which can be used to efficiently and relatively painlessly remove unwanted body hair by uprooting.

The principles and operation of a hair remover according to the present invention may be better understood with reference to the drawings and the accompanying description.

Figure 1:
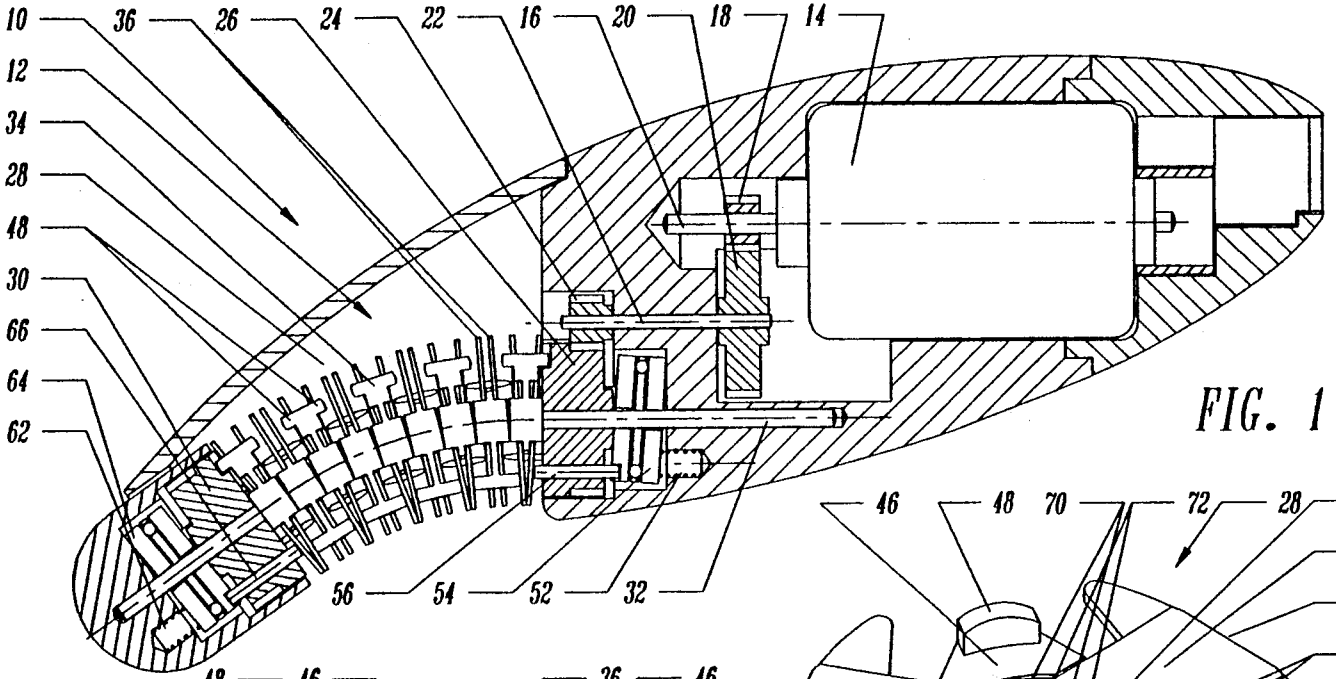
FIG. 1 is a side cross sectional view of one embodiment of a hair remover according to the present invention featuring a number of disc assemblies.

Referring now to the drawings, FIG. 1 illustrates a preferred embodiment of a hair remover according to the present invention. The hair remover is made up of two portions—a housing 10, or handle, which is manually grippable by the user, preferably using one hand; and a hair-plucking assembly 12.

Housing 10 may have any convenient shape and orientation. For example, in FIG. 1 housing 10 is represented as a handle-like extension of hair-plucking assembly 12. It will be apparent that housing 10 may also be oriented differently, for example, directly over hair-plucking assembly 12 (See, for example, FIG. 4 described below).

Preferably, housing 10 serves both as a grippable handle and further serves to house a motor 14, which may be of any suitable type, including, but not limited to, any of a large variety of miniature motors. Motor 14 may be operated by any convenient power source, such as house current and/or a battery (not shown), preferably a rechargeable battery.

Housing 10 further contains a reduction gear system which serves to convert the rotational speed produced by motor 14 to the proper rotational speed of hair-plucking assembly 12. Any suitable reduction gear system may be used. In the system illustrated in FIG. 1, a motor shaft 16 is connected to, or is integrally formed with, a motor shaft gear 18 which meshes with, and serves to rotate, a larger reduction gear 20 mounted on a reduction gear shaft 22. Also mounted on reduction gear shaft 22 is a drive gear 24 of suitable size which meshes with, and serves to rotate, a posterior hair-plucking assembly end member 26 which, in turn, serves to rotate the disc assemblies, as described below.

It should be apparent that any of a large number of suitable systems may be used to provide the required rotational motion to hair-plucking assembly 12 and that the system illustrated in FIG. 1 is exemplary only and is not meant, in any way, to limit the scope of the present invention.

Figure 3:
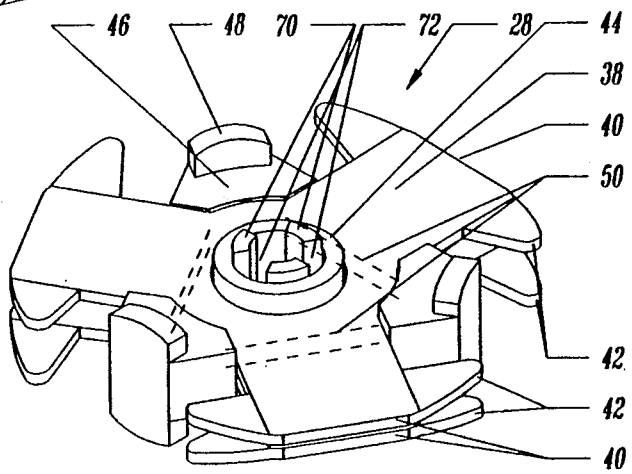
FIG. 3 is a perspective view of the disc assembly of FIG. 2.
Figure 2:
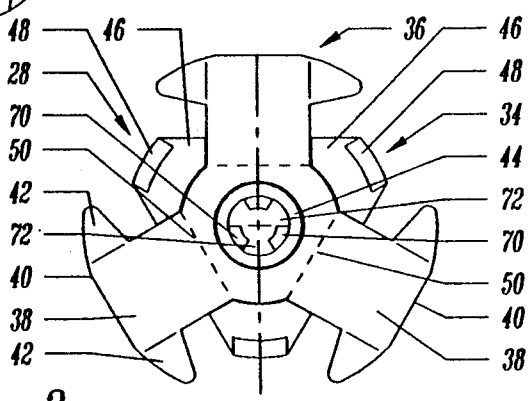
FIG. 2 is a plan view of a disc assembly such as might be used in the device of FIG. 1.

The present invention is embodied in hair-plucking assembly 12, one embodiment of which is illustrated in FIG. 1, with details in FIGS. 2 and 3.

Hair-plucking assembly 12 is made up of one or more disc assemblies 28. The illustrative embodiment of FIG.

1 includes nine disc assemblies 28. Hair-plucking assembly 12 also preferably includes posterior hair-plucking assembly end member 26 which serves to transmit the rotational motion produced by motor 14 to hair-plucking assembly 12 and further serves as a pressure plate to support hair-plucking assembly 12, and an anterior hair-plucking assembly end member 30 which serves as a bearing to allow hair-plucking assembly 12 to rotate smoothly throughout its length and further serves as a pressure plate to support hair-plucking assembly 12.

Posterior hair-plucking assembly end member 26, anterior hair-plucking assembly end member 30 and each of disc assemblies 28 is each rotatably mounted on an arcuate shaft 32, at least one of whose ends is firmly anchored in housing 10. The manner of rotation of disc assemblies 28 is described below. Arcuate shaft 32 may be made of any suitable material, including various rigid or flexible materials. When a flexible material is used, arcuate shaft 32 must be anchored at both of its ends in order to preserve its desired degree of curvature.

Preferably, arcuate shaft 32 is made of a rigid material, such as any of a number of suitable rigid metals. Use of a rigid shaft reduces the 'give' or 'play' in the hair plucking device and allows for the quick and relatively painless removal or hair.

Preferably the curved portion of arcuate shaft 32 has a constant radius of curvature. The degree of curvature of arcuate shaft 32 is selected to meet a number of criteria. First, as will become more apparent below, the curvature must be such that disc assemblies 28 are caused to efficiently and smoothly form and undo traps for hair. Second, the curvature should preferably approximately match the natural curvature, or contours, of those portions of the body, e.g. legs, on which the device is to be used.

Hair-plucking assembly 12 includes, primarily, a plurality of disc assemblies 28. FIGS. 2 and 3 are plan and perspective views, respectively, of a typical disc assembly 28, such as that used in FIG. 1. Disc assembly 28 is made up of three elements—a hub 34, and a pair of discs 36. The three elements may each be a separate entity, as described in more detail below, or any two or all three may be integrally formed to form two units or a single unit. Each of these elements may be made of any suitable material. Preferably, each is made of a rigid material so as to reduce the 'give' in the system and reduce the level of discomfort during the hair plucking process, as described above in a different context. Preferably, hub 34 is made of rigid plastic, such as nylon, while discs 36 are made of metal, such as stainless steel.

Preferably, discs 36 of each disc assembly 28 are identical. Most preferably, all discs 36 and all hubs 34 are identical, which facilitates the assembly and maintenance of a device according to the present invention.

Each of discs 36 features at least one radially extending arm 38 which extends from its central portion. In the embodiment of FIGS. 2 and 3, each disc features three radially extending arms 38 oriented 120° apart. Each arm 38 terminates in a flattened peripheral portion 40. The construction of flattened peripheral portion 40 is such that when it is pressed against the corresponding flattened peripheral portion 40 of the complementary disc 36 a trap is formed which tends to grasp and hold any hair strands which happen to be located between the two peripheral portions 40 when the trap is closed.

Preferably, each arm 38 of discs 36 also includes angled leading walls 42 which are connected to flattened peripheral portions 40 which serve to funnel hair into the trap area so as to increase the quantity of hair which is grasped and uprooted each time the trap is set.

Preferably, angled leading walls 42 are also found on the trailing edge of each flattened peripheral portion 40. It is to be noted in this context that disc assemblies 28 are preferably completely symmetrical with respect to rotation about arcuate shaft 32 such that disc assemblies 28 may be readily made to rotate either clockwise or counterclockwise. This feature increases the versatility of a device according to the present invention since a single device, equipped with a reversible motor or other means for reversing the rotational sense, can accommodate both right handed and left handed users. Similarly, it may be desirable for a particular user to periodically reverse the rotational direction of the device during use in order to optimize the hair removal efficiency of the device and the user's comfort. For example, a reversal of rotational direction may be called for when a right-handed user wishes to use different stroke directions in treating a different part of the body without having to switch hands or rotate the device.

The central portion of each disc 36 features an opening, preferably substantially circular, which is sized and shaped to fit over a projection of hub 34, which is described in more detail below.

Hub 34 includes a central portion which includes, on both axially-directed faces of hub 34, central projections 44 which are sized and shaped to accommodate the openings of discs 36 and to serve as support points to facilitate the tilting of hub 34. The tolerances between central projections 44 of hub 34 and the central openings of discs 36 are such that discs 36 are not prevented from pivoting as described below in such a way that one portion of the opening of discs 36 is located near the juncture of central projection 44 and the body of hub 34 while the opposite portion of the opening is located along projection 44 at a position which is somewhat remote from the juncture of central projection 44 and the body of hub 34.

In alternative embodiments suggested above, disc assembly 28 is made up not of two discrete discs 36 and a discrete hub 34 but rather the two discs 36 may be integrally formed with each other, or one or both of discs 36 may be integrally formed with hub 34. In such a configuration the formation of the trap is achieved, at least partially, by the bending of one or both of discs 36 rather than as described above. To ensure proper operation, the material of construction and/or the thickness of portions of disc assembly 28 must be used to allow disc or discs 36 to bend properly so as to form the traps.

Hub 34 features shoulders 46, one shoulder 46 per arm 38 of disc 36. In the embodiment illustrated in FIGS. 2 and 3 discs 36 each features three arms 38 and hence hub 34 features three shoulders 46. Shoulders 46 are sized and shaped such that the leading edge of each arm 38 abuts against a portion of one of shoulders 46. In this way, a rotational motion of hub 34 transmits the same rotational motion to discs 36.

Preferably, the trailing edge of each arm 38 also abuts against a portion of one of shoulders 46. In this way, disc assembly 28 is symmetrical with respect to rotation in either sense and rotational motion of hub 34 in either sense transmits the same rotational motion to discs 36.

Extending from shoulders 46 of hub 34 is a pair of axial protrusions 48, extending substantially axially in opposite senses. Each of axial protrusions 48 extends axially beyond the plane of arm 38 of the corresponding disc 36 such that, during that portion of the rotation of disc assemblies 28 when a particular set of axial protrusions 48 is located in the concave configuration produced by the curvature of arcuate shaft 32 (as best seen in the lower portion of FIG. 1) axial protrusions 48 extend through the open spaces between adjacent arms 38 of discs 36 to touch the nearer disc 36 of an adjoining disc assembly 28, thereby causing the adjoining disc assembly 28 to form a trap.

The formation of a trap is effected through suitable design of disc assembly 28, and in particular, through the careful selection of the size and shape of hub 34 and discs 36. Specifically, hub 34 includes an edge 50 which lies between each pair of corresponding arms 38 of complementary discs 36. Edge 50 is roughly perpendicular to arcuate shaft 32 and lies at a radial distance from the axis of arcuate shaft 32 which is significantly less than the radial distance of flattened peripheral portion 40. The above-described geometry is such that whenever axial protrusions 48 of adjoining disc assembly or assemblies 28 press discs 36 together, a pair of arms 38 of complementary discs 36 pivot slightly toward each other about the corresponding edge 50 of hub 34 located between the pair of arms 38. This pivoting motion brings the pair of flattened peripheral portions 40 at the end of the pair of arms 38 together in parallel fashion to form a trap.

In another embodiment according to the present invention, edge 50 of hub 34 further includes a pinch plate which projects radially outwardly from edge 50. The thickness of the pinch plate is smaller than that of edge 50 so that arms 38 of discs 36 are still able to pivot about edge 50 as described above. The pinch plate has a width which approximates, and preferably equals, that of flattened peripheral portion 40 and extends from edge 50 so as to be flush with flattened peripheral portion 40. In such an embodiment, the pivoting or bending of arms 38 of discs 36 towards each other effects the creation of two traps—one between one face of the pinch plate and one of flattened peripheral portions 40 of one of discs 36, and the other between the other face of the pinch plate and the flattened peripheral portions 40 of the complementary disc 36.

Preferably, a device according to the present invention further includes additional means for urging pairs of flattened peripheral portions 40 together, so as to prolong the time during which the pair of corresponding flattened peripheral portions 40 of discs 36 remain together to form a trap.

A variety of means for carrying out this function may be envisioned. One technique is shown in FIG. 1 and involves anteriorly biasing arm 38 of the posterior-most disc 36 and simultaneously posteriorly biasing arm 38 of the anterior-most disc 36. In both cases, the arms 36 being biased are those located in the concave configuration produced by the curvature of arcuate shaft 32, as can be seen in the lower portion of FIG. 1. The biasing tends to remove any slack which might be present and which could cause arms 36 to prematurely separate, undoing the trap and prematurely releasing the trapped hair before it has been sufficiently displaced as to have been uprooted.

The above-described biasing can be achieved, for example, as shown in FIG. 1, through use of a mechanism which includes a biasing spring 52 mounted in housing 10 which eccentrically anteriorly urges a tilted pressure bearing 54. Tilted pressure bearing 54, in turn, anteriorly urges a biasing rod 56 which is slidably mounted in posterior hair-plucking assembly end member 26 and which serves to anteriorly urge the posterior-most disc 36. Preferably, one biasing rod 56 is provided for each arm 38 of discs 36.

A similar mechanism can be implemented at the anterior end of hair-plucking assembly 12 with a second biasing spring 62 which eccentrically posteriorly urges a second tilted pressure bearing 64. Second tilted pressure bearing 64, in turn, posteriorly urges a second biasing rod 66 which is slidably mounted in anterior hair-plucking assembly end member 30 which serves to posteriorly urge the anterior-most disc 36. The rotation of disc assemblies 28 is preferably effected by transferring rotational motion from posterior hair-plucking assembly end member 26, which is driven by motor 14, to the posterior-most hub 34, as by use of grooves in posterior hair-plucking assembly end member 26 which engage the posteriorly-directed axial protrusions 48 of posterior-most hub 34 so that rotational motion of posterior hair-plucking assembly end member 26 translates into rotational motion of posterior-most hub 34 and disc assembly 28. Alternatively, rotation can be transmitted from posterior hair-plucking assembly end member 26 to the posterior-most hub 34 through engagement means including protrusions and recessions, as described below. A similar arrangement, preferably identical for ease of assembly, is also provided at the anterior end of hair-plucking assembly 12.

Hub 34 preferably features means for engaging an adjoining hub 34 so that rotational motion of one hub 34 imparts rotational motion to an adjoining hub 34.

One such engagement means is illustrated in FIGS. 2 and 3 and was previously disclosed in detail in my earlier U.S. Pat. Nos. 4,935,024 and 5,057,115, which have been incorporated by reference. Specifically, hub 34 includes, in and around its central opening, a series of axial engagement protrusions 70 and recessions 72 for engaging corresponding protrusions 70 and recessions 72 of an adjoining hub 34. Such engagement means ensures that adjoining hubs 34 are angularly offset from each other by the desired angles and assures that the adjoining disc assemblies 28 interact properly, as described herein.

It will be readily appreciated that while the illustrated disc assemblies 28 feature discs 36 having three arms 38 and a hub 34 which is triangular in shape, other configurations are possible and may, in some cases be desirable. For example, it may be desirable to use discs having four arms and hubs which are roughly square in shape. In such a configuration, it will be necessary to use a hub engagement means having four, rather than three, pairs of protrusions 70 and recessions 72. Such a configuration would result in the formation of four traps per disc per rotation compared to three traps which are afforded with the embodiment of FIGS. 1–3.

Figure 6:
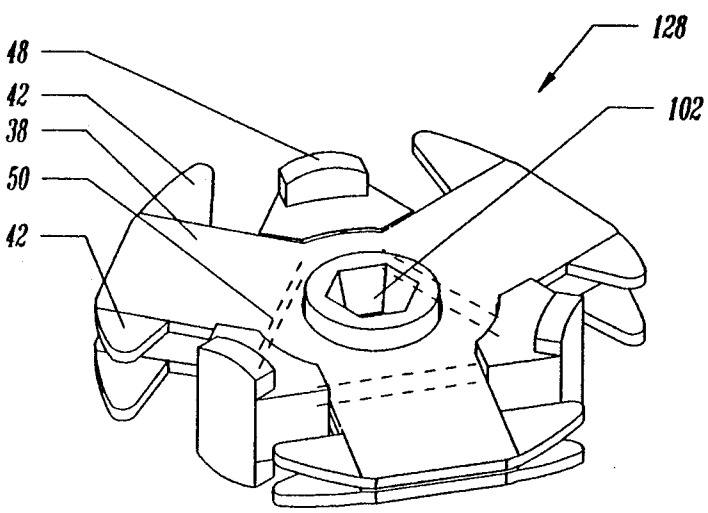
FIG. 6 is a perspective view of the disc assembly of FIG. 5.
Figure 5:
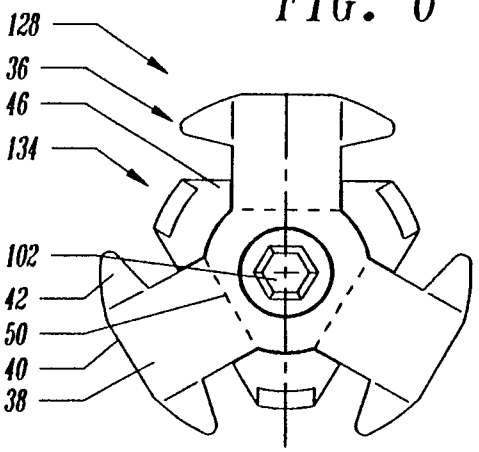
FIG. 5 is a plan view of a disc assembly such as might be used in the device of FIG. 4.
Figure 4:
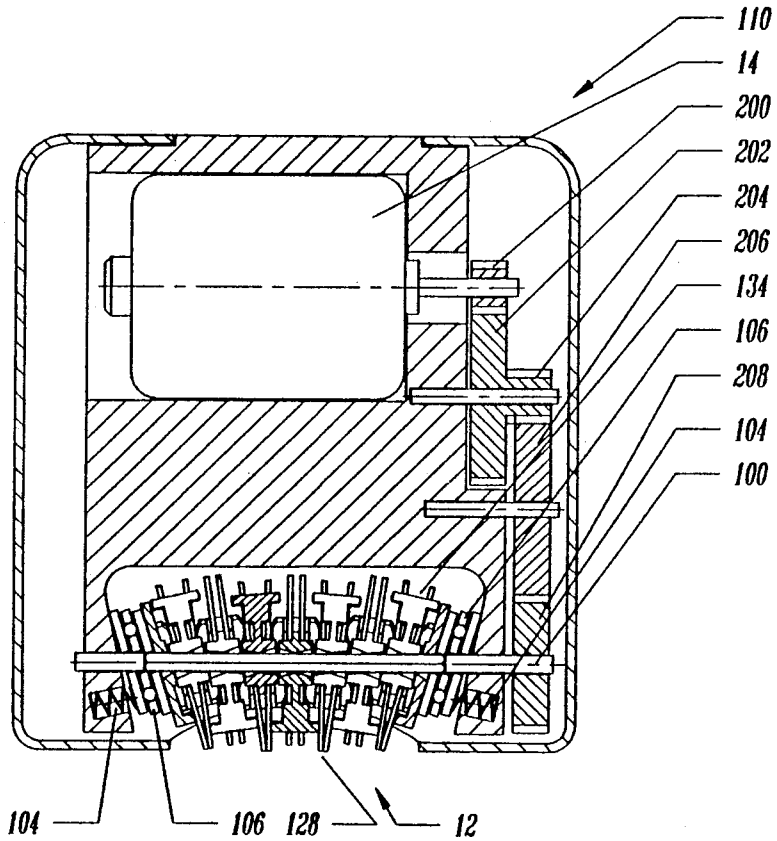
FIG. 4 is a side cross sectional view of another embodiment of a hair remover according to the present invention featuring a number of disc assemblies.

Another embodiment of a hair remover according to the present invention is shown in FIGS. 4–6. The embodiment in question is similar to that shown in FIGS. 1–3 in most respects but includes a number of differences which are noteworthy.

First, it is to be noted that housing 110 is now shown as lying directly above hair-plucking assembly 12 rather than as extending sideways as in the previously described embodiment.

Of more importance, the device of FIGS. 4–6 features disc assemblies 128 which are each rotated not by an adjoining assembly but by a straight drive shaft 100 connected to motor 14 through a suitable gear reduction system, which may include gears 200, 202, 204, 206, and 208.

The discs 36 of each disc assembly 128 can be the same as those used in the basic embodiment of FIGS. 1–3. However, hubs 134 of this embodiment lack the engagement means which allow a hub to rotate, and be rotated, by its neighbor. Instead, each hub 134 features, about its center, means for engaging drive shaft 100 so that rotation of drive shaft 100 serves to rotate hub 134.

Various such engagement means may be envisioned. Shown in FIGS. 4–6 is a mechanism whereby each hub 134 is equipped with a hexagonal opening 102 having internal walls which taper down from both faces of hub 134 to the midpoint of hub 134. Such an arrangement allows hubs 134 to be tiltingly stacked side by side and makes it possible for drive shaft 100 to impart suitable rotational motion to each hub 134.

Since a device as illustrated in FIGS. 4–6 lacks an arcuate shaft to induce the alternating formation and undoing of hair traps, other means must be provided to bring about the tilting of the discs 36 and the creating of traps. Various such means may be contemplated. One means is shown in FIG. 4 and includes the use of tilted mounting walls on either side of the stack of disc assemblies 128. The arrangement may further include a pair of biasing springs 104 which inwardly bias a pair of tilted pressure bearings 106 which, in turn, inwardly tilt disc assemblies 128 to form the desired traps.

While the invention has been described with respect to a limited number of embodiments, it will be appreciated that many variations, modifications and other applications of the invention may be made.

What is claimed is:

1. A device for removing body hair, comprising:

(a) a manually grippable housing; and (b) a hair-plucking assembly rotatably mounted to said housing, said hair-plucking assembly including at least one disc assembly, said disc assembly including:

(i) a pair of complementary discs, each of said discs having at least one radial arm extending in a plane, said arm terminating in a flattened peripheral portion which, when pressed against the corresponding portion of the other disc forms a trap for the hair; and (ii) at least one hub for mounting one of said pair of discs on each of two axial faces of said hub, said hub having at least one shoulder for engaging said at least one arm of each of said pair of discs so as to impart rotational motion to said pair of discs upon rotation of said hub about an axis of said hub, said hub having at least a pair of protrusions which extend axially beyond the plane of said arm of each of said pair of discs, said hub further having an edge substantially perpendicular to the axis of said hub such that said at least one pair of arms of said discs is pivotable about said edge so as to alternately bring said corresponding flattened peripheral portions of said discs together to form a trap and apart to eject the removed hair, said hub further including engagement means for engaging at least one adjoining hub so that rotational motion of one hub imparts rotational motion to at least one adjoining hub.

2. A device as in claim 1 wherein said discs are made of rigid material.

3. A device as in claim 2 wherein said discs are made of metal.

4. A device as in claim 1 wherein said hair-plucking assembly includes a plurality of disc assemblies and wherein all of said disc assemblies are identical.

5. A device as in claim 1 wherein said hair-plucking assembly includes a plurality of disc assemblies and wherein said disc assemblies are symmetrical with respect to clockwise or counterclockwise rotation of said disc assemblies.

6. A device as in claim 1 wherein said hair-plucking assembly includes a plurality of disc assemblies and wherein said arms or said discs further include an angled leading wall connected to said flattened peripheral portions of said discs to funnel hair into said trap.

7. A device as in claim 1 wherein each of said discs includes three arms and said hub is triangular in shape.

8. A device as in claim 1 wherein said at least one hub is rotatably mounted on a fixed arcuate shaft, said arcuate shaft having a convex portion and a concave portion.

9. A device as in claim 8 further comprising urging means for prolonging the time during which said pair of corresponding flattened peripheral portions of said discs remain together to form a trap.

10. A device as in claim 9 wherein said hair-plucking assembly includes a plurality of disc assemblies and wherein said urging means includes anteriorly biasing said arm near the concave portion of said arcuate shaft of one of said discs and posteriorly biasing said arm near the concave portion of said arcuate shaft of one another of said discs.

11. A device as in claim 9 wherein said hair-plucking assembly includes a plurality of disc assemblies and wherein each of said hubs includes engagement means for engaging said rotatable shaft so that rotational motion of said shaft imparts rotational motion to said hub.

12. A device as in claim 1 wherein said engagement means includes at least one axial protrusion and at least one axial depression on each hub for engaging corresponding depressions and protrusions of at least one adjoining hub.

13. A device as in claim 1 wherein said at least one hub is mounted on a rotatable substantially straight shaft.

14. A device as in claim 13 wherein said hair-plucking assembly includes a plurality of disc assemblies, the device further comprising a tilting means for tilting each pair of discs together during at least one portion of the rotation of said disc assemblies about said shaft.

15. A device as in claim 14 wherein said hair-plucking assembly includes a plurality of disc assemblies, and wherein said tilting means includes tilted end walls connected to said housing, each of said end walls tilting an outer disc assembly towards the center of said shaft.

16. A device for removing body hair, comprising:

(a) a manually grippable housing; and (b) a hair-plucking assembly rotatably mounted to said housing, said hair-plucking assembly including at least one disc assembly, said disc assembly including:

(i) a pair of complementary discs, each of said discs having at least one radial arm extending in a plane said arm terminating in a flattened peripheral portion which, when pressed against the corresponding portion of the other disc forms a trap for the hair; and (ii) at least one hub for mounting one of said pair of discs on each of two axial faces of said hub, said hub having at least one shoulder for engaging said at least one arm of each of said pair of discs so as to impart rotational motion to said pair of discs upon rotation of said hub, about an axis of said hub, said hub having at least a pair of protrusions which extend axially beyond the plane of said arm of each of said pair of discs, said hub further having an edge substantially perpendicular to the axis of said hub such that said at least one arm of each of said discs is movable about said edge so as to alternately bring said corresponding flattened peripheral portions of said discs together to form a trap and apart to eject the removed hair, said hub further including engagement means for engaging at least one adjoining hub so that rotational motion of one hub imparts rotational motion to at least one adjoining hub.

17. A device as in claim 16 wherein said pair of discs are permanently connected to each other.

18. A device as in claim 16 wherein one of said pair of discs is permanently connected to said hub.

19. A device as in claim 16 wherein said hair-plucking assembly includes a plurality of disc assemblies and wherein each of said pair of discs are permanently connected to said hub.

20. A device as in claim 16 wherein said pair of discs are permanently connected to each other and to said hub.

* * * * *